US008327949B2

(12) United States Patent
Meixner

(10) Patent No.: US 8,327,949 B2
(45) Date of Patent: Dec. 11, 2012

(54) HANDHELD POWER TOOL WITH A HANDLE VIBRATION-DAMPED BY COMPENSATING MEANS

(75) Inventor: Gerhard Meixner, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 358 days.

(21) Appl. No.: 12/677,090

(22) PCT Filed: Jul. 7, 2008

(86) PCT No.: PCT/EP2008/058740

§ 371 (c)(1),
(2), (4) Date: Mar. 8, 2010

(87) PCT Pub. No.: WO2009/033841

PCT Pub. Date: Mar. 19, 2009

(65) Prior Publication Data

US 2010/0206594 A1 Aug. 19, 2010

(30) Foreign Application Priority Data

Sep. 7, 2007 (DE) ..... 10 2007 042 721

(51) Int. Cl.
*B25D 17/24* (2006.01)
*B25D 17/04* (2006.01)

(52) U.S. Cl. ..... 173/162.2; 173/162.1; 173/170; 403/119; 16/431

(58) Field of Classification Search ..... 173/162.1, 173/162.2, 170; 403/119; 16/431
See application file for complete search history.

(56) References Cited

U.S. PATENT DOCUMENTS

| | | | | | |
|---|---|---|---|---|---|
| 1,778,553 | A | * | 10/1930 | Gartin | 173/162.2 |
| 2,989,870 | A | * | 6/1961 | Stahl | 74/98 |
| 3,322,211 | A | * | 5/1967 | Alabuzhev et al. | 173/162.2 |
| 3,451,492 | A | * | 6/1969 | Blomberg et al. | 173/162.2 |
| 3,495,798 | A | * | 2/1970 | Galbarini et al. | 248/364 |
| 4,279,091 | A | * | 7/1981 | Edwards | 42/1.06 |
| 5,025,870 | A | * | 6/1991 | Gantner | 173/162.2 |
| 2008/0000664 | A1 | | 1/2008 | Steinke | |

FOREIGN PATENT DOCUMENTS

| | | | |
|---|---|---|---|
| GB | 2171045 | A | 8/1986 |
| WO | WO 2004082897 | A1 * | 9/2004 |

* cited by examiner

*Primary Examiner* — Brian D Nash
*Assistant Examiner* — Michelle Lopez
(74) *Attorney, Agent, or Firm* — Maginot, Moore & Beck

(57) ABSTRACT

A hand-held power tool is proposed, having a drive device for driving a tool, which is arranged in a housing of the power tool. A handle of the power tool, which is movably connected to the housing of the power tool, is vibration-damped by a movable compensating element. For this purpose, the movable compensating element is operatively connected to the handle and/or the housing of the power tool by a deflecting system.

19 Claims, 11 Drawing Sheets

HANDHELD POWER TOOL WITH A HANDLE VIBRATION-DAMPED BY COMPENSATING MEANS

CROSS-REFERENCE TO RELATED APPLICATION

This application is a 35 USC 371 application of PCT/EP2008/058740 filed on Jul. 7, 2008.

BACKGROUND OF THE INVENTION

1. Prior Art Field of the Invention

The invention relates to a handheld power tool.

The handheld power tool has a drive device, disposed in a power tool housing, for driving a tool. The drive device and/or the tool generate oscillations, which are transmitted as vibration to a power tool user. The handheld power tool furthermore has a handle that is vibration-damped via a movable compensating element. The movable compensating element is preferably disposed in the power tool housing and/or in the handle. Preferably, the movable compensating element is embodied as a movably supported counterweight. The mass inertia of the counterweight acts in damping fashion on the amplitude of the vibrations.

2. Description of the Prior Art

Methods and devices for vibration-damping of the handle are known. For instance, spring-loaded and/or elastically damping handles are employed. In arrangements, the handle is decoupled from the vibration-excited power tool housing via the spring/damper system. In addition, split, spring-loaded and/or damped housings are used, in order to decouple the housing from the vibration-excited components, such as the drive device.

ADVANTAGES AND SUMMARY OF THE INVENTION

The handheld power tool of the invention has a movable compensating element, which is operatively connected to the handle and/or the power tool housing via a deflection system. By means of the deflection system, an action of the movable compensating element on the handle is achieved. The operative relationship between the handle and the movable compensating element that is brought about by the deflection system has the advantage that the movable compensating element can be constructed quite compactly and provided with only a slight mass. Thus at comparatively little effort or expense, considerable damping of the vibration transmitted to the power tool user is attained.

It is considered to be a further advantage that the movable compensating element does not contribute significantly to the total weight of the handheld power tool; that is, the capability of manipulating of a handheld power tool vibration-damped in accordance with the invention is improved perceptibly.

By means of the drive device of the handheld power tool, vibrations along a main axis of vibration are generated, particularly in the case of a hammering drive of the tool, such as rotary and/or chisel hammers. By means of a degree of freedom of the movable compensating element, which extends essentially in a main axis of vibration of the power tool housing, an advantageous and especially compact structural form of the handheld power tool according to the invention can be attained.

In a preferred embodiment, the deflection system has at least one and preferably two lever arms rotatably connected to one another. A reactive force caused by the drive device and/or the tool acts on a first lever arm. As a result of this force introduction, a highly effective and at the same time economical realization of the handheld power tool of the invention can be achieved.

An especially economical and compact embodiment of the handheld power tool of the invention can be attained by the action of a second lever arm on the movable compensating element.

In a preferred embodiment of the handheld power tool of the invention, the deflection system is constructed of two lever arms. One lever arm is connected, preferably rigidly, to the handle. Through an engagement opening in the power tool housing, this first lever arm engages a rotatable engagement point on the second lever arm. The second lever arm is supported by a rotary bearing point that is connected to the power tool housing. The rotatable engagement point is disposed at a spacing A from this rotary bearing point. The spacing A advantageously acts as an additional tuning parameter for the damping system.

In an alternative embodiment, a first lever arm is connected, preferably rigidly, to the power tool housing. Through a leadthrough opening in the handle, the first lever arm engages a rotatable engagement point on the second lever arm. The second lever arm is rotatably supported at a rotary bearing point that is connected to the handle. The rotatable engagement point is located at a spacing A from the rotary bearing point. The spacing A, which is freely selectable in its dimensions, advantageously permits an additional tuning of the damping system. It is considered to be a further advantage that producing a handheld power tool of the invention requires no interventions inside the power tool housing.

An especially economical embodiment of a handheld power tool of the invention can be attained by means the solid connection between the second lever arm and the movable compensating element. Preferably, the second lever arm and the movable compensating element are embodied in one piece.

By means of a deflection system with a third lever arm, especially effective vibration damping of the handheld power tool of the invention can be achieved. To that end, the third lever arm is connected rotatably to the second lever arm at a spacing B from the rotatable engagement point. The third lever arm now acts on the movable compensating element.

A compact embodiment of a deflection system according to the invention with three lever arms can be achieved by providing that the third lever arm is solidly connected to the movable compensating element. In an embodiment that is furthermore especially economical, the third lever arm is embodied in one piece with the movable compensating element.

By the use of at least one thrust-pivot gear mechanism in the deflection system, an especially strong action of the movable compensating element is attained.

An especially compact embodiment that at the same time is adaptable to given installation spaces is achieved by using at least one cable pull device in the deflection system.

A deflection system with at least one pressure body system is especially flexibly usable with regard to installation space and at the same time has especially good tunability of the damping properties.

An advantageous further development of the handheld power tool of the invention can be attained by means of a disposition of at least one and preferably two restoring elements on the movable compensating element. Upon a deflection of the movable compensating element from a position of repose, the restoring element exerts a restoring force FR on the movable compensating element. As a result, degrees of freedom for the design of the damping system are advantageously attained.

A further advantageous refinement of the handheld power tool of the invention can be attained by means of the disposition of at least one and preferably two damping elements on the movable compensating element. Upon a deflection of the movable compensating element from a position of repose, the damping element acts in damping fashion on the motion of the movable compensating element. Advantageously, degrees of freedom are thus obtained in terms of the design of the damping system. In particular, the damping system of the handheld power tool of the invention can be adapted ideally to the load profile.

A handle for a handheld power tool, in particular a rotary anchor chisel hammer, is connected movably to a power tool housing of the handheld power tool. Moreover, the handheld power tool has at least one vibration-damping movable compensating element, preferably at least one movably supported counterweight. According to the invention, the movable compensating element is operatively connected to the handle and/or the power tool housing via a deflection system, as a result of which especially effective and at the same economical vibration damping of the handle is achieved.

BRIEF DESCRIPTION OF THE DRAWINGS

Several exemplary embodiments of the invention are shown in the drawings and explained in further detail in the ensuing description in conjunction with the drawings, in which.

DESCRIPTION OF THE PREFERRED EMBODIMENTS

The handheld power tool 10 shown in the examples is an electrically operated handheld power tool. It has at least one drive device 12, comprising at least one electric motor 12*a* with at least one motor shaft 12*b* and at least one gear mechanism 12*c* coupled to the motor shaft 12*b*. The gear mechanism 12*c* serves at least to convert a rotary motion of the motor shaft 12*b* into a translational motion along a power tool axis 12*d* defined by the tool. The handheld power tool 10 can be embodied as a chisel hammer and/or rotary hammer, in which the drive device 12 serves to actuate a hammer impact mechanism 13. Further examples of handheld power tools 10 with at least one drive, alternating between two terminal positions, of a tool are percussion screwdrivers, percussion power drills, and compass saws, straight back hand saws, or saber saws.

Figure 1:
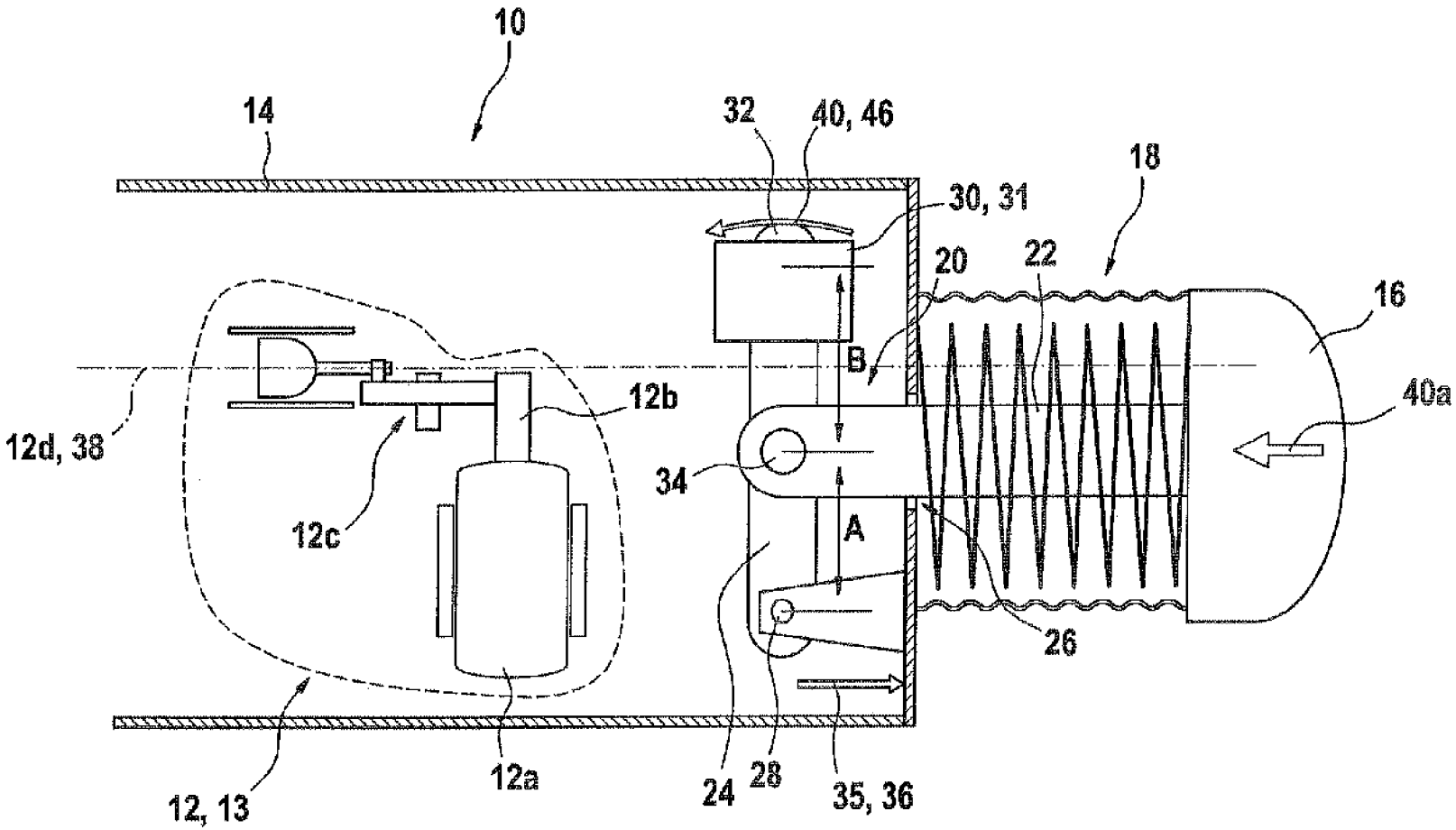
FIG. 1 is a schematic side view of a handheld power tool of the invention with a two-arm deflection system.

The handheld power tool 10 of the invention shown in FIG. 1 has a power tool housing 14 and a handle 16 connected to the power tool housing 14. The drive device 12 is disposed in the power tool housing 14. The drive device 12 here is indicated schematically as a hammer impact mechanism. The handle 16 is connected to the power tool housing 14 via a spring element 18. In other embodiments, the handle 16 can additionally or alternatively be connected to the power tool housing 14 via at least two spring elements and/or at least one, two or more damping elements.

The handheld power tool 10 of the invention furthermore has a deflection system 20. The deflection system 20 includes a first lever arm 22 and a second lever arm 24.

The first lever arm 22 is rigidly connected to the handle 16. The first lever arm 22 protrudes into the power tool housing 14 through an engagement opening 26. In other embodiments, the first lever arm may also be connected to the handle 16 elastically, rotationally, and/or displaceably.

The second lever arm 24 of the deflection system 20 is disposed in the power tool housing 14. The second lever arm 24 is rotatably supported at a rotary bearing point 28 that is braced on the power tool housing 14. The movable compensating means 30 is embodied as a counterweight 31. The counterweight 31 is disposed on the end 32 of the second lever atm 24 that is remote from the rotary bearing point 28. The counterweight 31 is connected solidly to the second lever arm 24.

The end reaching through the engagement opening 26 of the first lever arm 22 engages a rotatable engagement point 34 on the second lever arm 24. The rotatable engagement point 34 is spaced apart from the rotary bearing point 28 by a first spacing A.

The function of the handheld power tool 10 of the invention will now be explained. As a result of the action of the drive device 12, a reactive force 36, called a repulsion force 35, acts on the power tool housing 14. The vibrations thus generated propagate preferentially along a main axis of vibration 38 in the power tool housing 14.

The handle 16 is braced on the power tool housing 14 by the spring element 18. The rotary bearing point 28 of the second lever arm 24 connected rigidly to the power tool housing 14 follows a motion of the power tool housing 14 directly. Because of its mass inertia, the movable compensating means 30 on the end 32 of the second lever arm 24 remote from the rotary bearing point 28 follows this motion only with a delay. Via the rotatable engagement point 34 disposed at a second spacing B from the movable compensating means 30, the delayed motion is transmitted to the first lever arm 22. Since the first lever arm 22 is rigidly connected to the handle 16, a relative motion 40 is created between the handle 16 and the power tool housing 14. As a result of this relative motion 40, vibrations or oscillations are sent onward to the handle with a reduced amplitude.

By the dimensioning of the movable compensating means 30 or in other words of the counterweight 31, tuning of the damping behavior relative to the handheld power tool 10 is possible.

During the design of the handheld power tool 10, the action of the movable compensating means 30 can be varied by way of the distribution of the spacings A and B. Thus the spacings A and B act as design parameters.

Figure 2:
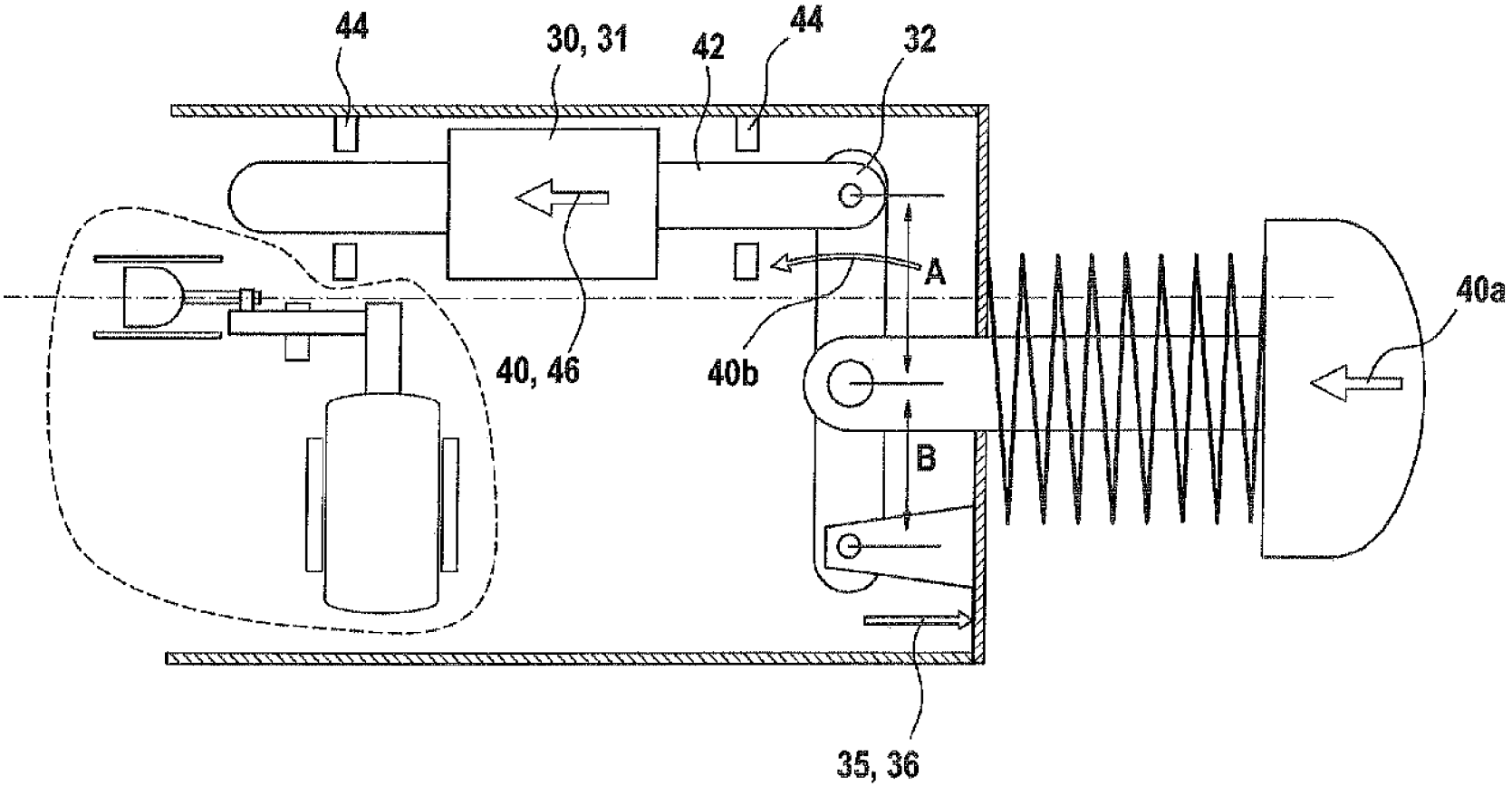
FIG. 2 is a schematic side view of a handheld power tool of the invention with a three-arm deflection system.

FIG. 2 shows a refinement of the handheld power tool 10 of the invention, as a second embodiment. Identical elements have the same names and are identified by the same reference numerals. A third lever arm 42 is connected rotatably to the end 32 of the second lever arm 24 remote from the rotary bearing point 28 at a spacing B from the rotatable engagement point 34 (as labeled in FIG. 1). The third lever arm 42 here is guided by two guide elements 44 parallel to the main axis of vibration 38. By varying the number of guide elements 44, in particular by having one, three or more guide elements 44, variants of the handheld power tool 10 of the invention can be obtained. A further development of the handheld power tool 10 of the invention is obtained by using bearing elements, such as slide bearings, needle bearings, or roller bearings, to improve the friction properties of the guide elements 44.

The third lever arm 42 acts on the movable compensating means 30, embodied here as a counterweight 31. In a preferred embodiment, the counterweight 31 is connected solidly to the third lever arm 42. In particular, in a further development of the handheld power tool 10 of the invention, the counterweight 31 and the third lever arm 42 can be embodied in one piece.

The guidance of the third lever arm 42 in the guide elements 44 assures that the movable compensating means 30 is movable only in the direction of the main axis of vibration 38. As a result, it has an especially efficient damping action on vibrations along the main axis of vibration 38.

Figure 3:
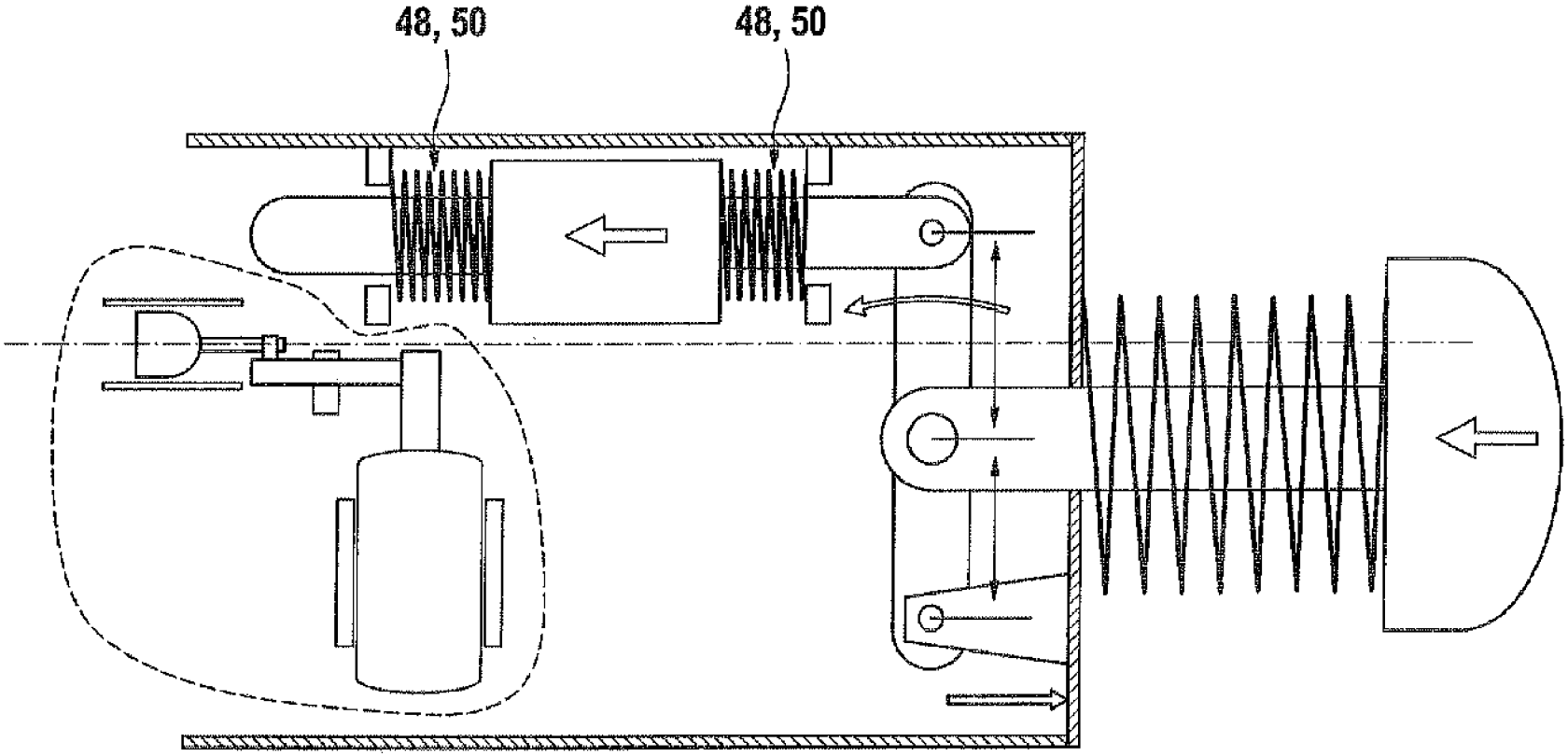
FIG. 3 shows a handheld power tool of the invention as in FIG. 2, with at least one restoring element and/or damping element in addition.

A preferred further development of the handheld power tool 10 of the invention is shown in FIG. 3. Identical elements are given the same names and provided with the same reference numerals whether enumerated in the present figure or previously. In the direction of the degree of freedom 46 of the movable compensating means 30, there are at least two restoring elements 48 and/or damping elements 50. The restoring elements 48 and/or damping elements 50 thus act in the direction of the degree of freedom 46 on the movable compensating means 30. The restoring elements 48 are embodied in FIG. 3 in an especially preferred form as spring elements 49.

Upon a deflection of the movable compensating means 30 out of a position of repose, the restoring elements 48 generate a restoring force FR on the movable compensating means 30. This force seeks to shift the movable compensating means 30 back into the position of repose.

Conversely, damping elements 50 act in damping fashion on the motions of the movable compensating means 30.

Variants of this exemplary embodiment of a handheld power tool 10 of the invention are obtained in particular by varying the number of restoring elements 48 and/or damping elements 50, particularly by having one, three, four or more restoring elements 48 and/or damping elements 50. An especially preferred variant is obtained by combining at least one restoring element 48 and at least one damping element. Further embodiments are obtained by varying the connecting means for connecting the restoring elements 48 and/or damping elements 50 to the movable compensating means or the power tool housing. In particular, the restoring elements 48 and/or damping elements 50 can be connected solidly to the movable compensating means or to the power tool housing or may merely contact them.

Figure 4:
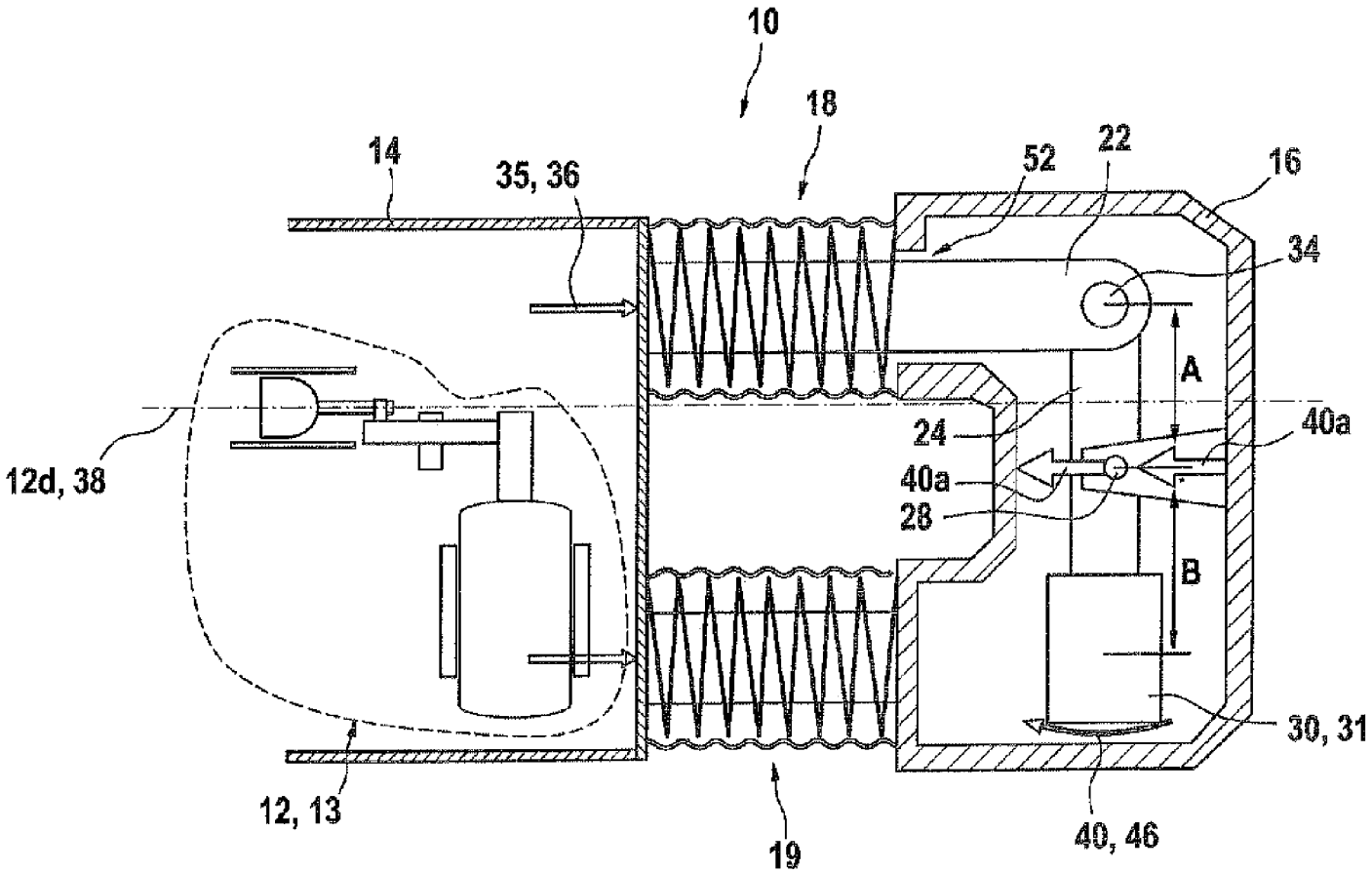
FIG. 4 is a schematic side view of a handheld power tool of the invention with a two-arm deflection system, in which the movable compensating means is disposed in the handle.

In FIG. 4, a further exemplary embodiment of a handheld power tool 10 of the invention is shown, in which the movable compensating means 30 is disposed in the handle 16. Identical elements are given the same names and provided with the same reference numerals. The handle 16 is braced on the power tool housing via a first spring element 18 and a second spring element 19.

In a departure from the exemplary embodiments described above, the first lever anti 22 is connected rigidly to the power tool housing 14. The handle 16 has a leadthrough opening 52, through which the first lever arm 22 is introduced into the handle 16.

The second lever arm 24 is pivotably supported in a rotary bearing point 28 connected rigidly to the handle 16. The first lever arm 22 engages the second lever arm 24 at a rotatable engagement point 34. The rotatable engagement point 34 is disposed at a spacing A from the rotary bearing point 28 on the second lever arm 24.

Variants are obtained in particular by the selection of the connection of the first lever arm 22 to the power tool housing and/or of the second lever arm 24 to the handle. In particular, the connection may be embodied elastically, rotationally elastically, and/or displaceably.

The movable compensating means 30 is disposed on an end of the second lever arm 24 remote from the rotatable engagement point 34.

Analogously to the exemplary embodiments described above, the drive device 12 generates a reactive force 36 that sets the power tool housing 14 in motion. The first lever arm 22, connected essentially rigidly to the power tool housing 14, transmits this motion to the pivotably suspended second lever arm 24. The direction of motion at the movable compensating means 30 relative to the motion of the power tool housing 14 is reversed by disposing the rotatable engagement point 34 and the movable compensating means 30 diametrically opposite one another, as viewed from the rotary bearing point 28.

Figure 5:
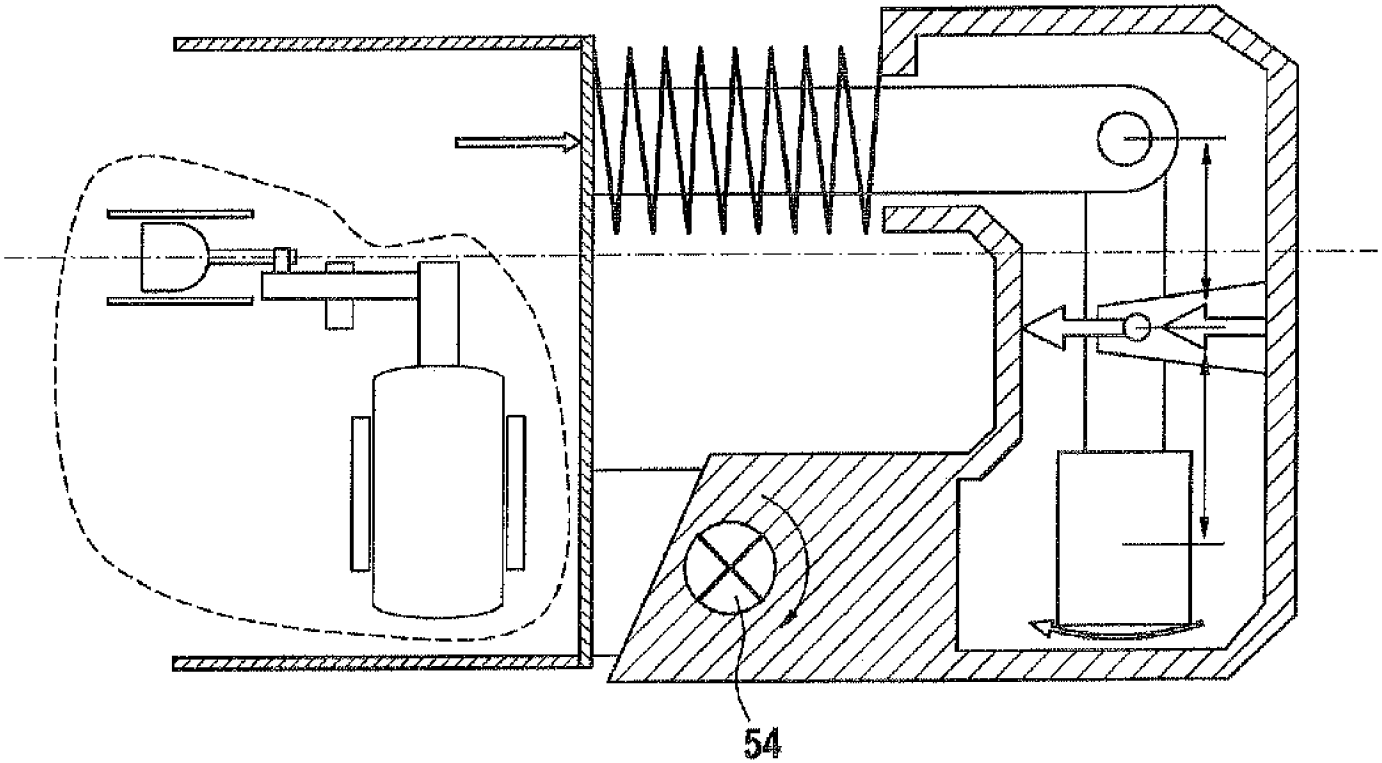
FIG. 5 shows an alternative embodiment to FIG. 4.

In a departure from the preceding exemplary embodiment, in FIG. 5 an embodiment is shown in which the second connection between the handle 16 and the power tool housing 14 is made via a pivot shaft 54. Further advantageous embodiments are obtained by means of elastic support of the pivot shaft.

Figure 6:
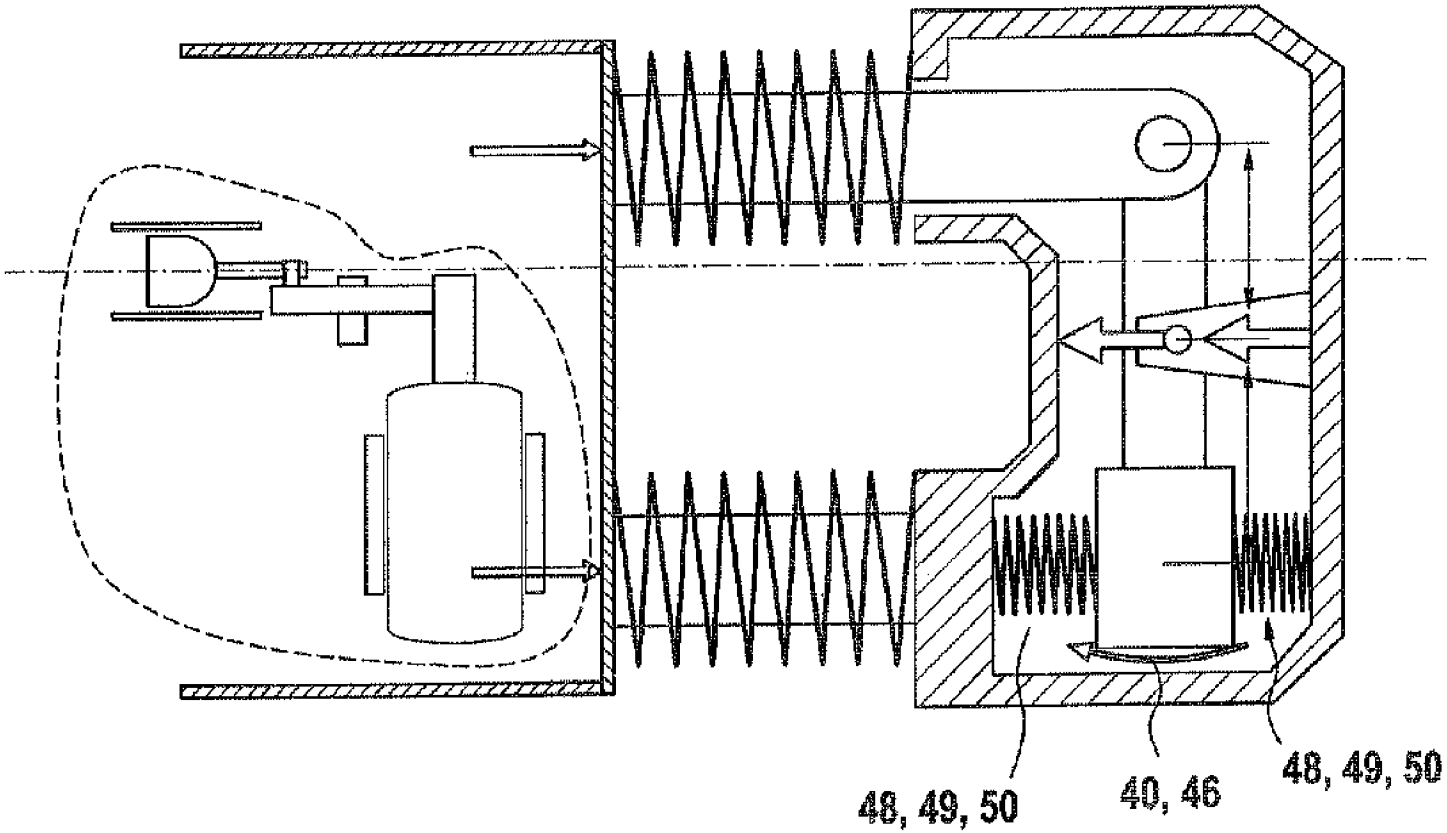
FIG. 6 shows an expanded embodiment compared to FIG. 4, having at least one restoring element and/or damping element.

The exemplary embodiment shown in FIG. 6 combines the exemplary embodiment of FIG. 4 with two restoring elements 48 and/or damping elements 50. The restoring elements 48 and/or damping elements 50 act analogously on the movable compensating means 30 to what has already been described for the exemplary embodiment of FIG. 3. Analogous refinements of the handheld power tool 10 of the invention as in the description for FIG. 3 are also possible.

Figure 7:
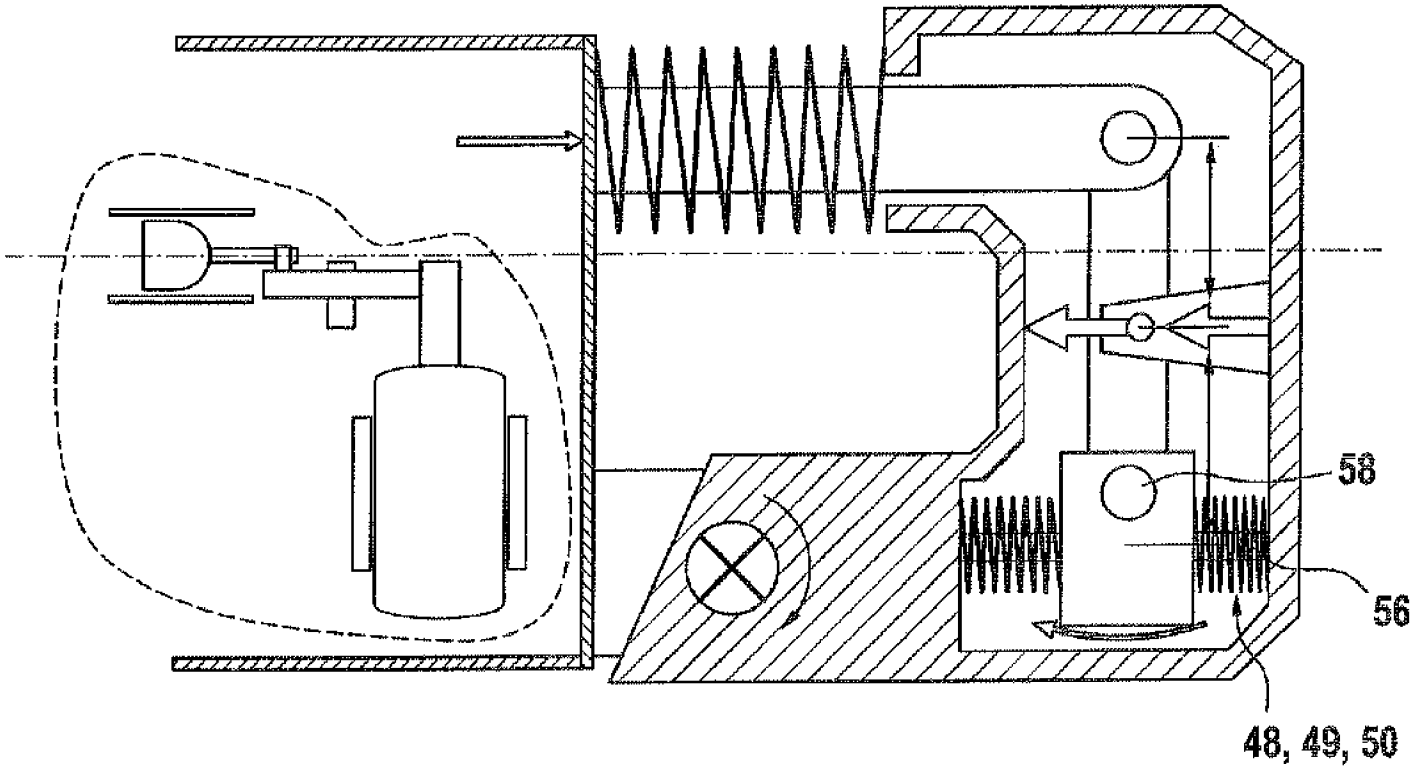
FIG. 7 shows an expanded embodiment of FIG. 5, with a restoring element and/or damping element.

In FIG. 7, an embodiment in accordance with FIG. 5 is shown, which is supplemented with two restoring elements 48 and/or damping elements 50. The mode of operation of the restoring elements 48 and/or damping elements 50 is as described above. Moreover, the movable compensating means 30 (not enumerated here, analogous to embodiments described above) is supported displaceably on a rigid, rectilinear guide rail 56. The second lever arm 24 engages a rotary bearing 58 on the movable compensating means 30. If because of a reactive force 36 acting on the first lever arm 22 the second lever arm pivots about the rotary bearing 58, then the movable compensating means is displaced along the guide rail 56. Further refinements of the guidance of the movable compensating means 30 are possible by means of special guide rails 56, which for example are shaped hyperbolically or parabolically and/or are not rigid.

Figure 8A:
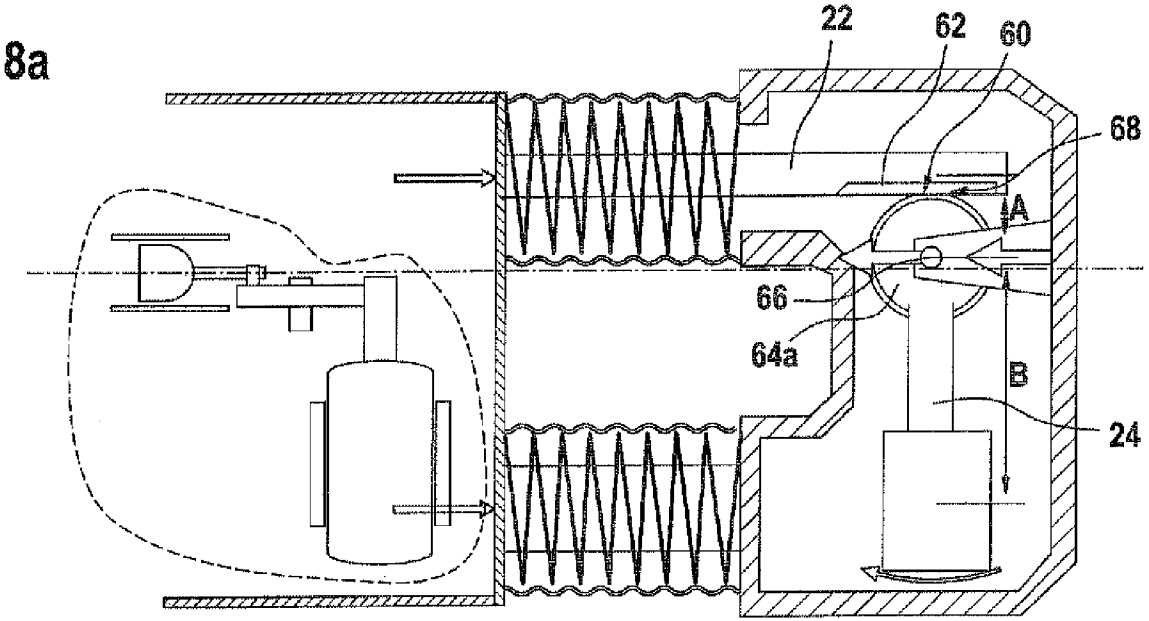
FIG. 8*a* shows an alternative embodiment to FIG. 4, using a thrust-pivot gear mechanism with a circular pivot element.
Figure 8B:
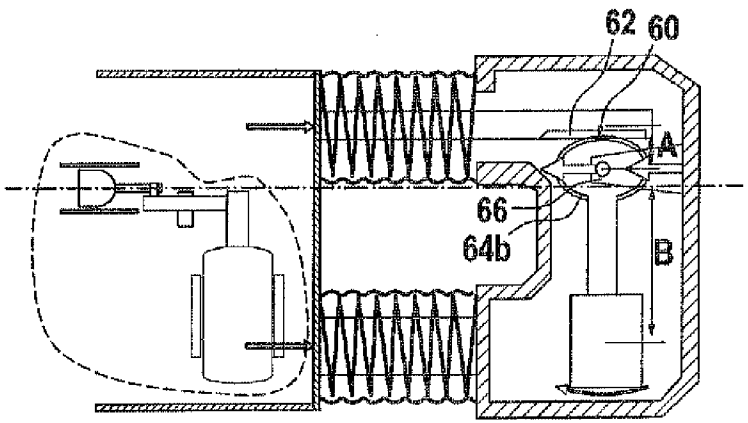
FIG. 8*b* shows an alternative embodiment to FIG. 8*b* with a cycloidal pivot element.

FIGS. 8*a* and 8*b* show two versions of a further exemplary embodiment of a handheld power tool 10 of the invention. In a distinction from the exemplary embodiments described above, the first lever arm 22 and the second lever arm 24 are operatively connected to one another by means of at least one thrust-pivot gear mechanism 60, in particular a rack and gear wheel mechanism, for instance, or a thrust rod/friction rod mechanism. The first lever arm 22 has a thrust element 62, in particular a toothed segment or friction segment, for example. This thrust element 62 is disposed on the side of the first lever arm 22 oriented toward the movable compensating means 30. The second lever arm 24 is preferably connected solidly to a pivot element 64, here embodied in particular as a circular gear wheel or friction wheel (64*a*, FIG. 8*a*) or cycloidal gear wheel or friction wheel (64*b*, FIG. 8*b*). The pivot element 64 is rotatably supported about a pivot shaft 66 connected solidly, preferably rigidly, to the handle 16.

Analogously to the exemplary embodiments described above, the drive device 12 generates a reactive force 36 that sets the power tool housing 14 in motion. The first lever arm 22 connected essentially rigidly to the power tool housing 14 transmits this motion to the second lever arm 24 via the thrust-pivot gear mechanism 60. As a result of the disposition of both the thrust-pivot gear mechanism 60 and the movable compensating means 30 diametrically opposite the pivot shaft 66, the direction of motion at the movable compensating means 30 relative to the motion of the power tool housing 14 is reversed.

The damping action of the movable compensating means 30 in this arrangement is determined among other factors by the spacing B of the movable compensating means 30 from the pivot shaft 66 and by the spacing A between the pivot shaft 66 and the action range 68 of the thrust-pivot gear mechanism 60. The action of the movable compensating means 30 can also be varied by means of the design of a runround pivot element 64.

Refinements of these exemplary embodiments can be obtained by expansion and combination with characteristics of the previous exemplary embodiments, in particular by combination with restoring elements 48 and/or damping elements 50 that act on the movable compensating means 30, and/or by supplementing it with a third lever arm 42 as in FIG. 2 and/or a guide rail 56 in accordance with FIG. 7.

Figure 9A:
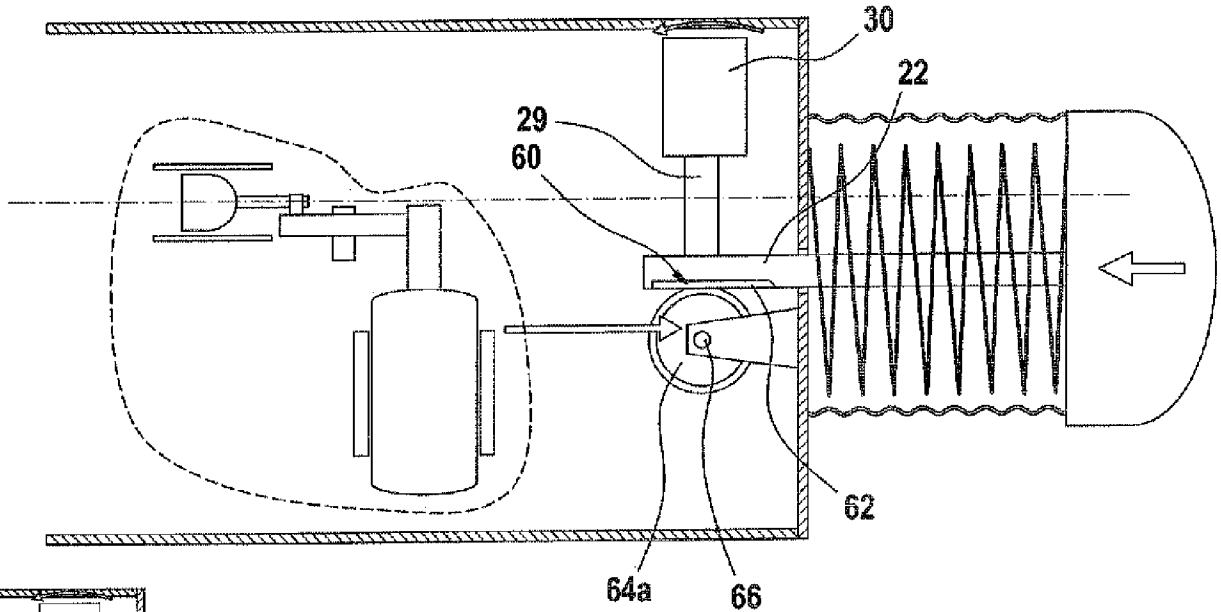
FIGS. 9*a* and 9*b* show alternative embodiments to FIG. 1, using a thrust-pivot gear mechanism with a circular and cycloidal pivot element, respectively.
Figure 9B:
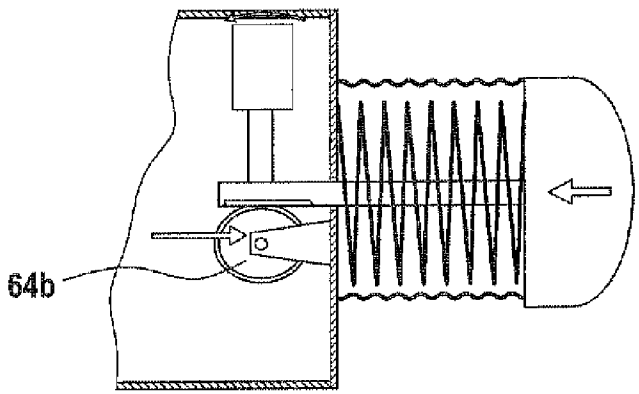

FIGS. 9*a* and 9*b* show a further embodiment of a handheld power tool according to the invention having at least one thrust-pivot gear mechanism 60 between the first lever arm 22 and the second lever arm 24 (not enumerated here); the movable compensating means 30 is disposed in the power tool housing 14. Here, the first lever arm 22 and the movable compensating means 30 are disposed on one and the same side of the pivot shaft 66. To that end, the thrust element 62 points away from the movable compensating means 30. The second lever arm 24 is connected solidly, preferably rigidly, to a pivot element 64 of the thrust-pivot gear mechanism 60. The pivot element 64 has a circular shape (64*a*, FIG. 9*a*), cycloidal shape (64*b*, FIG. 9*b*), or other shape.

In their mode of operation, these exemplary embodiments correspond to the embodiments of FIGS. 8*a* and 8*b*.

Refinements of these exemplary embodiments are obtained by additions and combinations suing characteristics of the preceding exemplary embodiments, in particular by combination with restoring elements 48 and/or damping elements 50 that act on the movable compensating means 30 and/or by adding with a third lever arm 42 as in FIG. 2 and/or a guide rail 56 in accordance with FIG. 7.

By means of further, alternative arrangements with at least two and preferably three or four lever arms, which deflect a reactive force, acting on the power tool housing 14, to a movable compensating means 30 in such a way that the movable compensating means 30 acts in damping fashion on the motion of the handle 16, further advantageous refinements of and additions to the handheld power tool 10 of the invention are possible.

In some cases, a disposition with a second and third lever arm 24, 42 connected to the movable compensating means 30 not rigidly but movably. Besides the embodiment shown in this exemplary embodiment, further variant ways of connecting the movable compensating means 30 to the second and third lever arms 24, 42 acting on the movable compensating means 30 are conceivable, such as with a toothed element or an alternative form-locking connection.

Alternatively or in addition, a suitable deflection system 20 according to the invention can be constructed on the basis of cable pull and/or Bowden cables and/or pneumatic and/or hydraulic elements.

Figure 10:
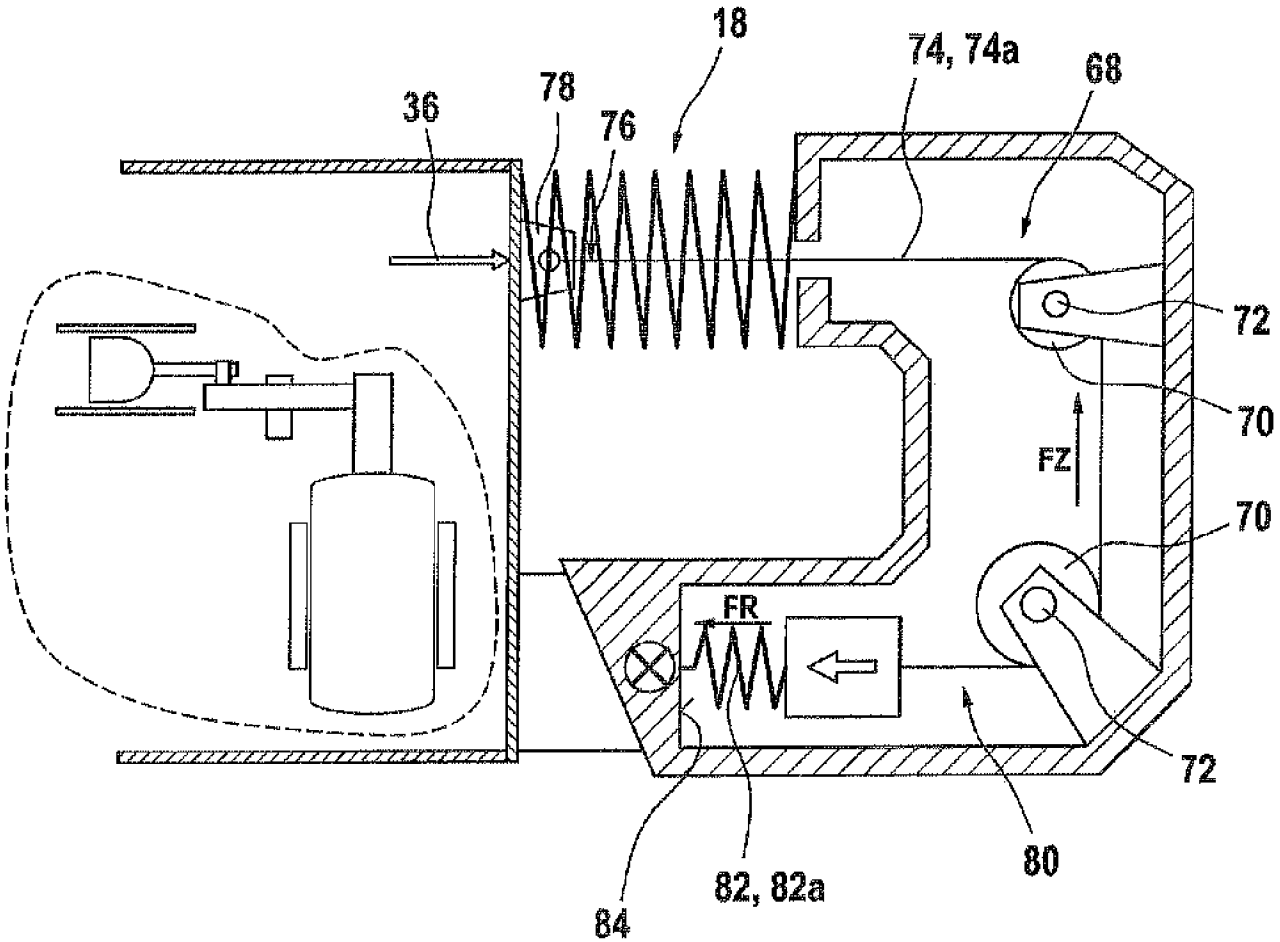
FIG. 10 shows a further embodiment analogous to FIG. 4, with a cable pull device as the deflection system.

FIG. 10 shows a handheld power tool 10 of the invention in which the deflection system 20 (not enumerated here) is constructed on a cable pull device 68. The cable pull device 68 includes at least one and preferably two, three or more deflection rollers 70. The deflection rollers 70 are each supported rotatably in the handle via a respective rotation shaft 72, and the rotation shafts 72 are connected solidly, preferably rigidly, to the handle. The cable pull device 68 furthermore includes a traction element 74, here embodied as a traction cable 74*a*. The traction cable is connected, preferably solidly, by its first end 76 to the power tool housing 14. In the present exemplary embodiment, the first end 76 is secured to a fastening eyelet 78 on the power tool housing 14 (not enumerated here). On the second end 80, the movable compensating means 30 (not enumerated here) is connected, preferably solidly.

The cable pull device 68 furthermore has a restoring element 82, here embodied as a restoring spring 82*a*. The restoring element 82 is disposed between an inner end face 84 and the movable compensating means 30 in such a way that upon the occurrence of a tensile force FZ on the traction cable, a restoring force FR acts on the movable compensating means. In a preferred embodiment, the restoring element 82 is ideally prestressed in such a way that upon a motion of the power tool housing 14 caused by a reactive force 36, the movable compensating means 30 can execute a compensatory motion in the opposite direction.

Expansions and/or alternative embodiments of the exemplary embodiment of FIG. 10 are obtained by varying the fastening of the cable ends 76, 80, in particular with fastening hooks, fastening leadthroughs, and/or similar fastening elements. Modifications by varying the number of deflection rollers 70, in particular one, three, four or more deflection rollers 70, and/or by varying the cable guidance are furthermore possible.

If a Bowden cable and/or a traction-thrust chain is used as the traction element 74, then a restoring element 82 can be dispensed with.

A deflection system 20 (not enumerated here) according to the invention with a cable pull device 68 analogous to the exemplary embodiment of FIG. 10 can also be used for disposing the movable compensating means 30 in the power tool housing and/or can be obtained with other forms of handles and/or fastenings, especially with a second spring element 19 as in FIG. 2, for example, as a variation of the example in FIG. 10.

Figure 11:
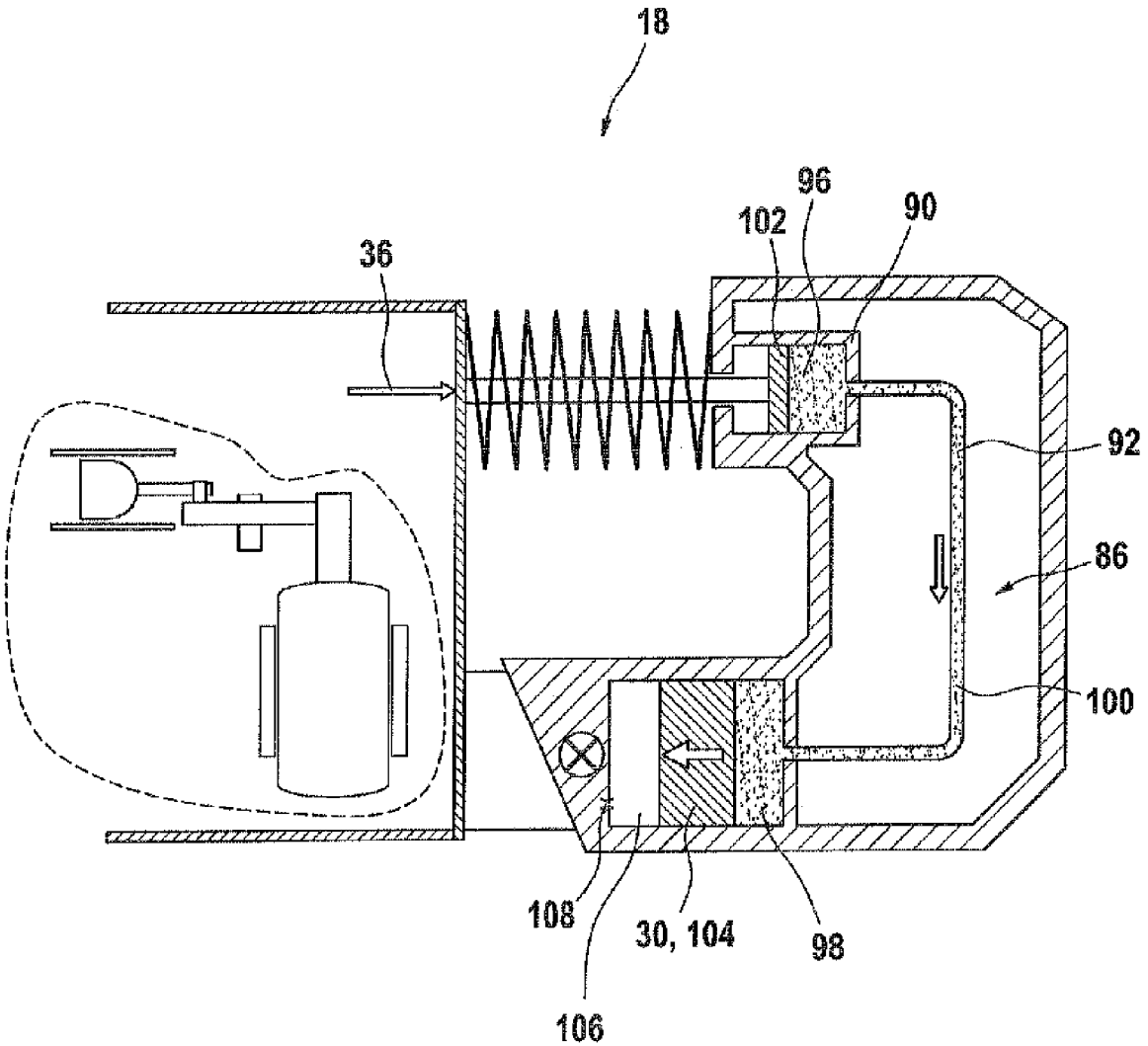
FIG. 11 shows a further embodiment analogous to FIG. 4, with a pressure hull system as the deflection system.

In FIG. 11, a further exemplary embodiment of a handheld power tool of the invention is shown, with a deflection system that is constructed as a pressure hull system 86. In the embodiment shown here, the pressure hull system 86 is disposed in the handle 16 (not enumerated here. The pressure hull system 86 has a storage cylinder 90 and a pressure line 92. The pressure hull system further includes a compensation cylinder. The storage cylinder 90 encloses a storage volume 96. The compensation cylinder includes a compensation volume 98. The storage volume 96 and the compensation volume 98 communicate with one another via the pressure line 92, and the total volume is filled with a fluid 100, preferably a gas or a liquid, in particular hydraulic oil.

The storage volume 96 is defined on one side by an axially displaceable storage piston 102. The first lever arm 22 (not enumerated here) is connected to the storage piston 102, preferably solidly and in particular in one piece.

The compensation volume 98 is defined on one side by an axially displaceable compensation piston 104. It is connected solidly, preferably rigidly, to the movable compensating means 30 (not enumerated here). In a preferred embodiment, the compensation piston 104 is made in one piece with the movable compensating means 30.

On the side of the compensation piston 104 diametrically opposite the compensation volume 98, there is a preferably air-filled ventilation volume 106. This volume communicates with the environment via a throttle restriction 108.

If a reactive force 36 is exerted via the power tool housing 14 on the first lever arm 22 and thus on the storage piston 102, then the fluid located in the storage volume 96 is compressed and positively displaced. The fluid escapes into the compensation volume 98 via the pressure line 92. As a result, the compensation piston 104 and thus the movable compensating means are displaced counter to the direction of motion of the power tool housing 14 (not enumerated here). The end located in the decreasing ventilation volume 106 can escape via the throttle restriction 108. Analogously, a reversal of motion of the movable compensating means 30 relative to the power tool housing 14 ensues in the event that a negative reactive force 36 acts on the power tool housing 14.

By the choice of a suitable fluid 100, in particular a gas—such as air—or a liquid—such as an oil—the damping action of a vibration damper according to the invention can be varied. Additional influence on the damping properties can be exerted by way of the dimensioning of the volumes 96, 98, 106 and of the pressure line 92. Furthermore, by the disposition of a throttle restriction in the pressure line 92, in particular a variable throttle restriction in the line, the damping can be varied. Finally, there is an additional tuning parameter in the dimensioning of the throttle restriction 108. In particular, the throttle restriction 108 can be designed variably in such a way that control of the damping characteristic by the user is possible.

Alternative embodiments of the exemplary embodiment of FIG. 11 are obtained among other ways by means of a disposition in the power tool housing. Combinations with other exemplary embodiments are also conceivable; in particular, additionally at least one restoring element 48 and/or damping element 50 that acts on the movable compensating means 30 can be integrated.

Further advantageous inventive variants can be obtained by dividing up the movable compensating means 30 into preferably two, three, four or more pressure elements that are embodied in particular as counterweights.

The foregoing relates to the preferred exemplary embodiments of the invention, it being understood that other variants and embodiments thereof are possible within the spirit and scope of the invention, the latter being defined by the appended claims.

The invention claimed is:

1. A handheld power tool, having at least one drive device, disposed in a power tool housing, for driving a tool, and having at least one handle which is vibration-damped via at least one movable compensating means disposed in the power tool housing and/or in the handle and embodied as a movably supported counterweight, the movable compensating means being operatively connected to the handle and to the power tool housing via a deflection system.

2. The handheld power tool as defined by claim 1, wherein at least one degree of freedom of the movable compensating means extends essentially in a main axis of vibration of the power tool housing.

3. The handheld power tool as defined by claim 2, wherein the deflection system has two lever arms rotatably connected to one another, and a reactive force caused by the drive device and/or the tool acts on a first lever arm of said two lever arms.

4. The handheld power tool as defined by claim 3, wherein a second lever arm of the lever arms acts on the movable compensating means.

5. The handheld power tool as defined by claim 1, wherein the deflection system has two lever arms rotatably connected to one another, and a reactive force caused by the drive device and/or the tool acts on a first lever arm of said two lever arms.

6. The handheld power tool as defined by claim 5, wherein a second lever arm of the lever arms acts on the movable compensating means.

7. The handheld power tool as defined by claim 1, wherein the deflection system is constructed of two lever arms, and a first lever arm, connected solidly, preferably rigidly, to the handle and reaching through an engagement opening in the power tool housing, engages a rotatable engagement point of a second lever arm at a spacing from a rotary bearing point connected solidly, preferably rigidly, to the power tool housing.

8. The handheld power tool as defined by claim 7, wherein the second lever arm is connected solidly, preferably rigidly, to the movable compensating means and is preferably embodied in one piece with the movable compensating means.

9. The handheld power tool as defined by claim 7, wherein the second lever arm is connected rotatably to a third lever arm at a spacing from the rotatable engagement point, and the third lever arm acts on the movable compensating means.

10. The handheld power tool as defined by claim 9, wherein the third lever arm is connected solidly, preferably rigidly, to the movable compensating means and is preferably embodied in one piece with the movable compensating means.

11. The handheld power tool as defined by claim 1, wherein the deflection system is constructed of two lever arms, and a first lever arm, connected solidly, preferably rigidly, to the power tool housing and reaching through a leadthrough opening in the handle, engages a rotatable engagement point of a second lever arm at a spacing from a rotary bearing point connected solidly, preferably rigidly, to the handle.

12. The handheld power tool as defined by claim 11, wherein the second lever arm is connected solidly, preferably rigidly, to the movable compensating means and is preferably embodied in one piece with the movable compensating means.

13. The handheld power tool as defined by claim 11, wherein the second lever arm is connected rotatably to a third lever arm at a spacing from the rotatable engagement point, and the third lever arm acts on the movable compensating means.

14. The handheld power tool as defined by claim 13, wherein the third lever arm is connected solidly, preferably rigidly, to the movable compensating means and is preferably embodied in one piece with the movable compensating means.

15. The handheld power tool as defined by claim 1, wherein the deflection system has at least one thrust-pivot gear mechanism.

16. The handheld power tool as defined by claim 1, wherein the deflection system has at least one cable pull device.

17. The handheld power tool as defined by claim 1, wherein the deflection system includes at least one pressure hull system.

18. The handheld power tool as defined by claim 1, wherein at least one and preferably two restoring elements are provided, which upon a deflection of the movable compensating means out of a position of repose exert a restoring force on the movable compensating means.

19. The handheld power tool as defined by claim 1, wherein at least one and preferably two damping elements are provided, which upon a deflection of the movable compensating means out of a position of repose act in damping fashion upon the motion of the movable compensating means.

* * * * *